US006491093B2

(12) United States Patent
Kreis et al.

(10) Patent No.: US 6,491,093 B2
(45) Date of Patent: Dec. 10, 2002

(54) COOLED HEAT SHIELD

(75) Inventors: Erhard Kreis, Otelfingen (CH); Christof Pfeiffer, Kuessaberg (DE); Ulrich Rathmann, Baden (CH)

(73) Assignee: ALSTOM (Switzerland) Ltd, Baden (CH)

( * ) Notice: Subject to any disclaimer, the term of this patent is extended or adjusted under 35 U.S.C. 154(b) by 75 days.

(21) Appl. No.: 09/726,521

(22) Filed: Dec. 1, 2000

(65) Prior Publication Data

US 2001/0005555 A1 Jun. 28, 2001

(30) Foreign Application Priority Data

Dec. 28, 1999 (DE) ..... 199 63 371

(51) Int. Cl.[7] ..... F01D 25/12

(52) U.S. Cl. ..... 165/169; 415/115; 415/116; 415/138; 415/139; 415/173.1; 415/178

(58) Field of Search ..... 415/110–112, 115, 415/116, 138, 139, 173.1, 175–178, 180; 165/169

(56) References Cited

U.S. PATENT DOCUMENTS 4,303,371 A 12/1981 Eckert
4,551,064 A * 11/1985 Pask ..... 415/115
4,573,866 A 3/1986 Sandy, Jr. et al.
4,902,198 A * 2/1990 North ..... 415/115
5,088,888 A * 2/1992 Bobo ..... 415/138
5,167,485 A * 12/1992 Starkweather ..... 415/115
5,375,973 A * 12/1994 Sloop et al. ..... 415/115
6,164,904 A * 12/2000 Abriles et al. ..... 415/139

FOREIGN PATENT DOCUMENTS

DE 19727407 A1 1/1999
EP 0516322 A1 12/1992

* cited by examiner

*Primary Examiner*—Christopher Verdier
(74) *Attorney, Agent, or Firm*—Burns, Doane, Swecker & Mathis, L.L.P.

(57) ABSTRACT

In a heat shield (10), in particular for the stator of gas turbines, which heat shield (10) is composed of a plurality of individual segments (10*a, b*; 20*a, b*), whose end surfaces (15*a, b*) respectively abut one another so as to form a gap (12), and which have cooling holes (13*a, b*) for cooling purposes in the region of the end surfaces (15*a, b*), through which cooling holes (13*a, b*) a cooling fluid is blown out into the gap (12), cooling is ensured, even when the gap is closed, by a chamber (11), which is widened relative to the gap (12) and into which the cooling holes (13*a, b*) open, being arranged in the region of the gap (12).

7 Claims, 1 Drawing Sheet

COOLED HEAT SHIELD

This application claims priority under 35 U.S.C. §§119 and/or 365 to APpln. Ser. No. 199 63 371.1 filed in Germany on Dec. 28, 1999; the entire content of which is hereby incorporated by reference.

FIELD OF THE INVENTION

The present invention refers to the field of thermal machines. The present invention relates to a heat shield, in particular for gas turbines.

Heat shields for gas turbines are known, for examples, from the publication U.S. Pat. No. 4,573,866 or EP-A1-0 516 322.

BACKGROUND OF THE INVENTION

In thermal machines such as gas turbines, there are certain contours (for example the annular, stator-side heat shields which surround the rotor blades of the rotor), which are composed of individual segments whose end surfaces abut one another so as to form gaps. Such segmented contours require cooling of the flanks by blowing out a cooling fluid, as a rule cooling air. For this purpose, special cooling holes are provided (88 in FIG. 2 of EP-A1-0 516 322 or C in FIG. 3 of U.S. Pat. No. 4,573,866), through which the cooling fluid is blown out into the gaps.

Under certain operational conditions, however, the gaps between the segments can become practically closed. The openings of the cooling holes emerging into the gaps are then covered by the side walls of the adjacent segments, which leads to a failure of the cooling in this region.

SUMMARY OF THE INVENTION

One of the objectives of the invention is, therefore, to create a heat shield which avoids the quoted disadvantages of known heat shields and, in particular, ensures sufficient cooling of the segment edges near the gaps even when the gaps are closed.

The core of the invention consists in providing, in the region of the outlet flow openings of the cooling holes, a widened space which ensures unhindered emergence of the cooling fluid even when the gap is completely closed.

The invention can be effected in a particularly simple manner if, in accordance with a preferred embodiment, the chamber is configured as a recess, which, starting from the thermally loaded side of the heat shield, extends into the gap. The depth of the chamber is then preferably a specified percentage, in particular between 10% and 90%, of the thickness of the heat shield in the region of the gap.

The length of the chamber is, preferably, a specified percentage of the width of the heat shield, in particular between 10% and 80%.

BRIEF DESCRIPTION OF THE DRAWINGS

Preferred embodiment(s) of the invention is/are disclosed in the following description and illustrated in the accompanying drawings, in which.

DETAILED DESCRIPTION OF THE INVENTION

Figure 1:
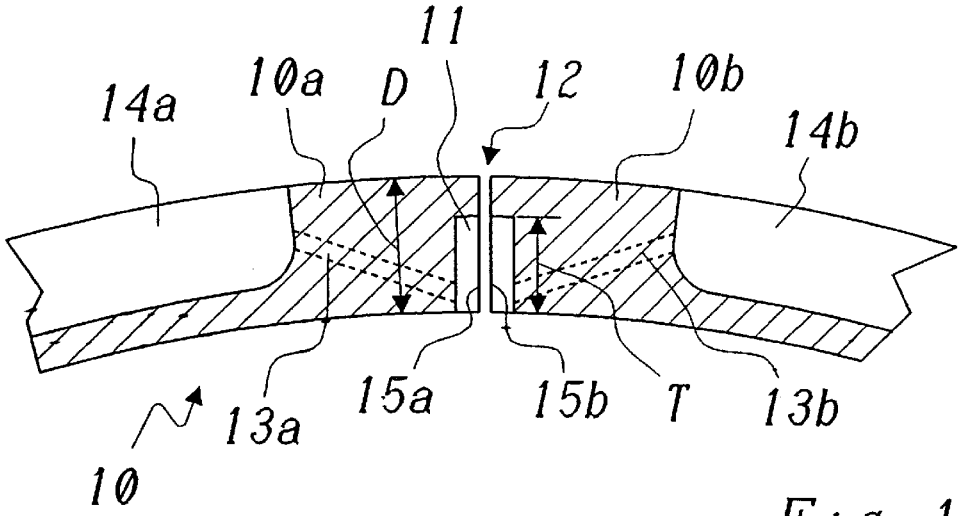
FIG. 1 shows a section, in a plane at right angles to the turbine center line (I—I in FIG. 2), through a heat shield in accordance with a preferred embodiment example of the invention.

FIG. 1 shows a section in a plane, at right angles to the turbine center line, through a heat shield 10 in accordance with an exemplary embodiment of the present invention. Of the total annular heat shield 10, two arc-shaped segments 10*a* and 10*b*, whose end surfaces 15*a* and 15*b* abut one another so as to form a gap 12, are shown as illustrated in FIG. 1. The heat shield 10 is subjected from the outside to a cooling fluid, usually cooling air, which also fills the supply spaces 14*a* and 14*b* provided on the outside of the segments 10*a* and 10*b*. The cooling fluid flows from the supply spaces 14*a* and 14*b*, which are configured as recesses, inter alia through corresponding cooling holes 13*a* 13*b* to the gap 12 and is there released into a chamber 11.

The chamber 11, which is, as a recess, let into the gap region from the hot-gas side (from underneath in FIG. 1) has a markedly increased width relative to the gap 12. Should the gap 12 close, this ensures that the cooling fluid can, nevertheless, flow out from the cooling holes 13*a* and 13*b* without hindrance and can emerge into the hot-gas space surrounded by the heat shield 10.

The depth T of the recessed chamber 11 depends essentially on the thickness D of the heat shield 10 and should be a certain percentage of D. A percentage of between 10% and 90% has been found expedient, i.e. $0.1\ D<T<0.9\ D$.

Figure 2:
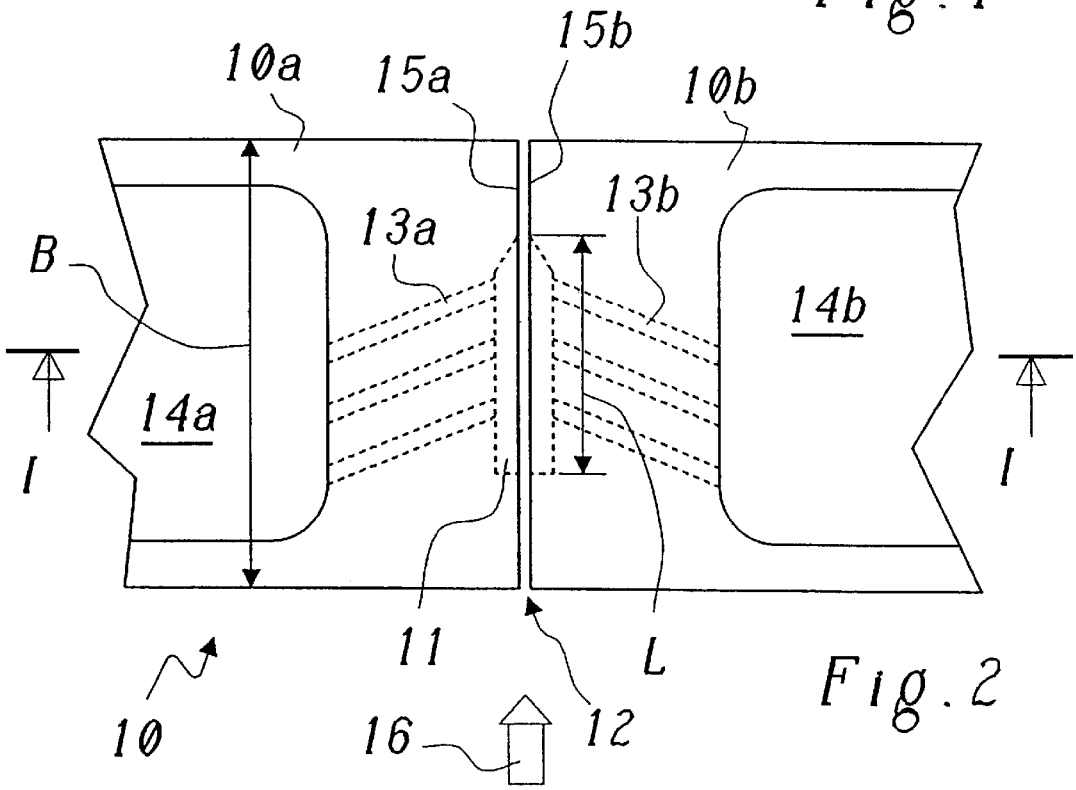
FIG. 2 shows the heat shield of FIG. 1 in plan view from the outside.

The design and position of the chamber 11 of the embodiment example in the axial direction is evident from FIG. 2. The length L of the chamber 11 is likewise a certain percentage of the width B of the heat shield 10, which percentage is preferably between 10% and 80%, i.e. $0.1\ B<L<0.8\ B$.

The cooling holes 13*a* and 13*b* expediently extend obliquely inward from the supply spaces 14*a*, 14*b* to the chamber 11—as may be seen from FIG. 1. Similarly, as shown in FIG. 2, the cooling holes 13*a, b* extend obliquely in the direction of the hot-gas flow 16 in order to ensure optimum interaction between the hot-gas flow and the emerging cooling fluid.

It is obvious that within the framework of the invention, the chamber 11 can also be otherwise designed and arranged in the gap region. In the case of a plurality of cooling holes, it is, similarly, conceivable to provide each cooling hole with its own chamber.

What is claimed is:

1. A heat shield, comprising:

a plurality of individual segments, said segments include end surfaces which respectively are aligned and spaced apart with respect to one another so as to form a gap, said segments each further including opposite side surfaces, with a first one of said opposite side surfaces being in contact with a cooling fluid, and a second one of said opposite side surfaces being in contact with a hot gas flow, and cooling holes being defined within each of said segments extending from said first side surface to the end surfaces and through which cooling holes a cooling fluid is blown out into the gap, said cooling holes opening into a chamber which is wider than the gap and is arranged in the region of the gap, wherein the chamber is configured as a recess which extends into the gap starting from the second side surface of each of said segments, said second side surfaces forming the thermally loaded side of the heat shield.

2. The heat shield as claimed in claim 1, wherein the chamber has a depth and the heat shield has a thickness, the depth of the chamber is a specified percentage of the thickness of the heat shield in the region of the gap.

3. The heat shield as claimed in claim 2, wherein the specified percentage is between about 10% to about 90%.

4. The heat shield as claimed in claim 1, wherein the chamber has a length and the heat shield has a width, the length of the chamber is a specified percentage of the width of the heat shield.

5. The heat shield as claimed in claim 4, wherein the specified percentage is between about 10% to about 80%.

6. The heat shield as claimed in claim 1, wherein the hot gas flows substantially parallel to said end surfaces of said segments, and said cooling holes extend obliquely to the direction of hot-gas flow.

7. The heat shield as claimed in claim 1, wherein said first side surface of each of said segments includes a recess, said cooling holes being defined within each of said segments extending from said recess to the end surfaces.

* * * * *